United States Patent [19]

Satoh et al.

[11] Patent Number: 4,622,113

[45] Date of Patent: Nov. 11, 1986

[54] PROCESS FOR PRODUCING CAUSTIC ALKALIS

[75] Inventors: Takao Satoh; Masaki Murakami; Nobuhiro Kawasaki, all of Yamaguchi; Teruo Ichisaka; Shinji Katayama, both of Okayama, all of Japan

[73] Assignees: Toyo Soda Manufacturing Co., Ltd., Shinnanyo; Chlorine Engineers Corp., Ltd., Tokyo, both of Japan

[21] Appl. No.: 673,122

[22] Filed: Nov. 19, 1984

[30] Foreign Application Priority Data

Nov. 17, 1983 [JP] Japan ..... 58-216613
Nov. 22, 1983 [JP] Japan ..... 58-220030

[51] Int. Cl.[4] ..... C25B 1/16

[52] U.S. Cl. ..... 204/98; 204/128; 204/255; 204/266

[58] Field of Search ..... 204/98, 128, 253–257, 204/258, 283, 296

[56] References Cited

U.S. PATENT DOCUMENTS

| | | | |
|---|---|---|---|
| 3,809,630 | 5/1974 | De Nora et al. | 204/98 |
| 3,923,630 | 12/1975 | Argade et al. | 204/258 |
| 4,059,495 | 11/1977 | De Nora et al. | 204/98 |
| 4,064,031 | 12/1977 | Kamarian | 204/258 |
| 4,152,225 | 5/1979 | Woodard, Jr. et al. | 204/98 |
| 4,184,939 | 1/1980 | Kadija | 204/98 |
| 4,201,652 | 5/1980 | Dupre, III | 204/258 |
| 4,209,380 | 6/1980 | Raetzsch et al. | 204/258 |
| 4,263,121 | 4/1981 | Christensen | 204/296 |
| 4,288,310 | 9/1981 | Knight et al. | 204/258 |
| 4,329,217 | 11/1982 | Byrd et al. | 204/283 |
| 4,432,857 | 2/1984 | Stanier | 204/253 |
| 4,443,315 | 4/1984 | Iijima et al. | 204/253 |
| 4,448,663 | 5/1984 | Dang et al. | 204/283 |

*Primary Examiner*—John F. Niebling
*Assistant Examiner*—Terryence Chapman
*Attorney, Agent, or Firm*—Oblon, Fisher, Spivak, McClelland & Maier

[57] ABSTRACT

Process or producing caustic alkalis or alkali hydroxides by electrolysis, employing a double electrode-type electrolysis tank in which a cation exchange membrane is provided to divide the inside of the tank into cathode and anode compartments, supplying to the anode compartment an alkali chloride, supplying water or a dilute solution of an alkali hydroxide into the cathode compartment, and taking away the alkali hydroxide and the hydrogen gas produced by electrolysis, in a mixed state of gas and liquid from the cathode compartment. The electrolysis tank comprises a number of finger-anodes extending from one of the walls of the tank and a number of finger-like hollow cathodes extending from the other wall of the tank, into which the finger-anodes project to form a gap therebetween, and a cation exchange membrane extending through the gap to divide the inside of the tank into cathode and anode compartments.

3 Claims, 18 Drawing Figures

PROCESS FOR PRODUCING CAUSTIC ALKALIS

BACKGROUND OF THE INVENTION

1. Field of the Invention

The present invention relates to improvements in a process for producing alkali hydroxides using a conventional double electrode diaphragm-type electrolysis tank with asbestos diaphragms for producing alkali hydroxides, the improvements comprising that the asbestos diaphragm is replaced by a cationic ion exchange membrane and a lower electrolysis cell voltage is applied to obtain alkali hydroxides of high purity and high concentration.

2. Description of the Prior Art

The mercury method for producing alkali hydroxides through the electrolysis of alkali chlorides has been replaced by the diaphragm method using an asbestos diaphragm from the view-point for preventing pollution. Today the diaphragm method is most popular and preferred for the production of alkali hydroxides.

One of the typical diaphragm types of electrolysis tanks using an asbestos diaphragm for the production of alkali hydroxides is a vertical double electrode diaphragm-type electrolysis tank described below.

A number of electrolysis tanks are set in a series with separating walls therebetween and finger-anodes having an approximately U-shaped cross-section extend from one side of the separating wall. On the other side of the separating wall are placed cathode backscreens having some distance from the separating wall. Finger-cathodes having almost the same shape as the finger-anodes but in the reversed direction extend from the cathode backscreen. Electricity supply bars penetrating the separating walls hold the fingers of the anode and cathode and supply electricity. In an electrolysis tank separated by the separating walls, a finger-anode and a finger-cathode, each extending from different separating walls are so arranged that the finger-anode projects into a small gap of the finger-cathodes, and vice versa, their arrangement having a close distance between. Further an asbestos diaphragm is composed beforehand by forming layers of asbestos slurry on a net of a finger-cathode.

For supplying electricity to the electrolysis tank, the anode at one end of a series of electrolysis tanks is connected to the plus terminal of the electricity supplier and the cathode at the other end is connected to the minus terminal.

In addition, each electrolysis tank is divided into anode and cathode compartments by an asbestos diaphragm. More particularly, the peripheral part of the cathode backscreen is connected to the flange on the side of the cathode compartment so that the inside of the finger-cathode and the space between the separating wall and the cathode backscreen form the cathode compartment. Using the asbestos diaphragm which is formed by depositing asbestos slurry on a bag-like finger-cathode, the electrolysis of alkali chloride is conducted with a level of the alkali chloride solution supplied to the anode compartment kept at a higher level, to obtain alkali hydroxide at the cathode compartment.

In a diaphragm-type electrolysis tank using an asbestos diaphragm, however, the solution of alkali hydroxide obtained at the cathode compartment is very dilute and contains a large amount of alkali chloride due to the permeability of the asbestos diaphragm toward the liquid. For instance, in an electrolysis of sodium chloride, a sodium hydroxide solution obtained is 10–13% by weight and contains 15–18% by weight of sodium chloride. For industrial applications, however, the solution chould be further concentrated and sodium chloride deposited during the process should be separated. In this case, the produce sodium hydroxide solution about 50% by weight stil contains about 1% by weight of sodium chloride, which brings about a difficulty in the direct application to such fields as the rayon industry.

In the meantime, an electrolysis method using an ion exchange membrane has recently been developed as a diaphragm-type electrolysis method which permits alkali hydroxide to be obtained in a high concentration without contamination of the sodium chloride.

Both methods belong to the diaphragm method in a general sense, therefore it may be possible to apply a cation exchange membrane as a diaphragm in place of an asbestos diaphragm as in the previous diaphragm-type electrolysis tanks. Thus, it is expected to obtain a high purity and a high concentration of alkali hydroxides without a large amount of expenditure on the apparatus, giving large merit to industrial manufacturing.

The present inventors have investigated the effects of a cation exchange membrane installed in place of asbestos in the double electrode diaphragm-type electrolysis tank mentioned in detail above in the production of alkali chloride by the electrolysis of alkali chloride.

In the investigation, however, several problems were noticed in simply exchanging the diaphragms, as discussed below.

At first each finger-cathode was covered by a bag-like membrane of a cation exchange material and sealed to assemble the electrolysis tank. Electrolysis was carried out maintaining the level of the sodium chloride solution supplied to the anode compartment at a higher level than the level of the sodium hydroxide solution in the cathode compartment and pumping out the hydrogen gas evolved at the upper portion of the cathode compartment. The result was that a very high voltage was needed across the electrolysis tank and the product of sodium hydroxide contained more iron than that in the case of the asbestos diaphragm and even more unfavorably, the sodium chloride content of the sodium hydroxide was increased as time went on with accompanying degrading current efficiency in producing sodium hydroxide in the cathode compartment.

When the present inventors used a higher pressure for the hydrogen gas in the cathode compartment than that of the chlorine gas in the anode compartment, they encountered serious difficulties of a high voltage to be applied across the electrolysis tank and a low current efficiency to obtain sodium hydroxide in the cathode compartment.

SUMMARY OF THE INVENTION

The first object of the present invention is to provide a process in which a high concentration of sodium hydroxide is obtained with a much lower applied voltage across the electrolysis tank than that necessary when an asbestos diaphragm is used only by installing a cation exchange membrane in a vertical double electrode diaphragm-type electrolysis tank where an asbestos diaphragm is used for producing alkali hydroxides.

The second object of this invention is to provide a process in which high purity alkali hydroxides containing the minimum amounts of iron and alkali chlorides possible is obtained through use of an electrolysis tank having a cation exchange membrane installed.

The third object of this invention is to provide a process in which alkali hydroxides can be produced with an electrolysis tank having the cation exchange membrane installed with a high current efficiency maintained for a long period of time.

The present inventors intensively investigated the above-mentioned problems in terms of their causes and how they should be solved. They found that these problems are concerned with the manner in which the cation exchange membrane is installed, how to take out the products resulting from electrolysis, that is, hydrogen and alkali hydroxides from the cathode compartment, and the structure itself of the finger-anode installed in the anode compartment. This investigation thus led to the completion of the present invention.

In summary, to attain the above-mentioned objects, the present invention includes the process of producing alkali hydroxides by electrolysis, employing a double electrode-type electrolysis tank in which a number of finger-anodes extending from one of two opposing separating walls and a number of finger-like hollow cathodes extending from the other separating wall are so composed in such a way that every finger projects into a narrow gap between the others keeping a small distance from each other and a continuous bag-like cation exchange membrane extends through these gaps, the peripheral portion of the membrane being sealed to flanges on the side of the cathode compartment of the electrolysis tank for the purpose of separating the inside of the tank into anode and cathode compartments, and supplying to the anode compartment an alkali chloride to produce a corresponding alkali hydroxide in the cathode compartment, comprising, the supply of water or a dilute solution of an alkali hydroxide from the bottom of the cathode compartment, taking away the alkali hydroxide produced as well as a hydrogen gas in a mixed state of a gas and liquid, from a nozzle placed at the upper part of the cathode compartment, and maintaining the level of the cathode solution at or above the level of the upper nozzle and the level of the anode solution at or below the level of the cathode solution for the electrolysis process.

The present invention further provides finger-anodes which can solve the above-mentioned problems by keeping the anode-cathode distance at a small constant value during the whole period of electrolysis while maintaining a uniform concentration of alkali chloride throughout the anode compartment. In addition, the finger-anodes can be reconstructed after use, through the application of a simple reconstruction process.

DETAILED EXPLANATION OF THE INVENTION

According to the results of the experiments carried out by the inventors, the elevation of the voltage across the electrolysis tank and the lowered current efficiency can be traced as stated in the following. In the condition of electrolysis, the hollow finger-anodes suffer a pressure from the cathode compartment via the cation exchange membrane as a result of a different specific gravity of the liquids. The pressure causes the finger-anodes to be distorted inside and the distance between the anode and cathode expands 2–3 times that of the distance between them before the electrolysis. At the same time, a smaller amount of alkali chloride is supplied into the anode compartment which is formed by each degraded finger-anode, and this leads to a non-uniform concentration of alkali chloride in the anode compartment. The total effect is manifested as the elevation of voltage across the tank and the lowering of the current efficiency.

The finger-anodes of this invention are composed as described below to attain the mentioned objects. In an assembled unit of a double electrode-type alkali chloride electrolysis tank, a number of finger-cathodes having a U-shaped horizontal cross-section are attached at their bases via a cathode backscreen to one end of an electricity supply bar connected to a separating wall and the bases of a number of finger-anodes having a U-shaped horizontal cross-section are attached to the other end of the electricity supply bar and the finger-cathodes are covered by a cation exchange membrane. The finger-anodes are characterized by being reinforced against outside pressures by one or more columns of anode supports installed in the inside of the U-shaped fingers in the longitudinal direction.

Even more remarkably, effective finger-anodes are composed as follows. In an assembled unit of a double electrode type alkali chloride electrolysis tank, a number of finger-cathodes having a U-shaped horizontal cross-section are attached at their bases via a cathode backscreen to one end of an electricity supply bar connected to a separating wall while the bases of a number of finger-anodes having a U-shaped horizontal cross-section are also attached to the other end of the electricity supply bar, and the finger-cathodes are covered by a cation exchange membrane. Characteristically, the finger-anodes are cut at their top portion in the longitudinal direction to form two anode plates, each of which is bent in the outward direction, thus giving a larger width of the finger-anode, at a location 10–50 mm from the base where it is connected to the electricity supply part. In the inside of the finger-anodes, one or more hollow anode supports are installed in the longitudinal direction at locations with a pitch of less than 200 mm and for the purpose of fixing the ends, a bringing plate is attached at the top ends of the two plates of an anode.

In the following, the process of the present invention will be explained in more detail with reference to the attached drawings.

Figure 1:
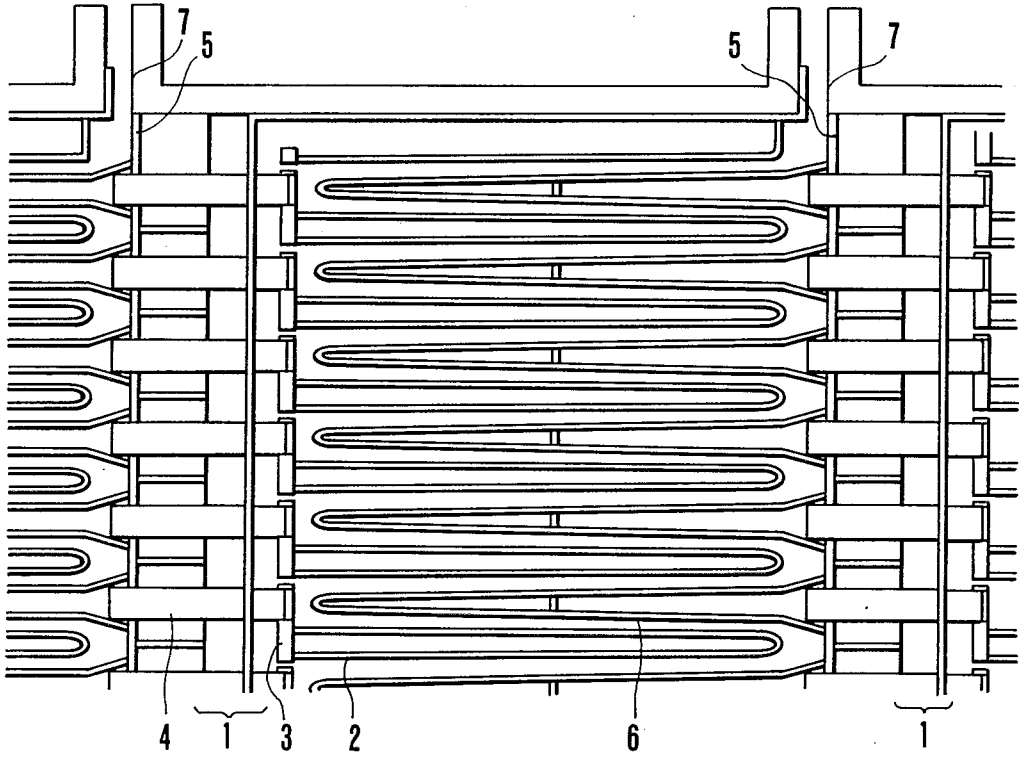
FIG. 1 is a horizontal cross-section, viewed from above of a unit of an electrolysis tank in a double electrode diaphragm-type electrolysis tank.
Figure 2:
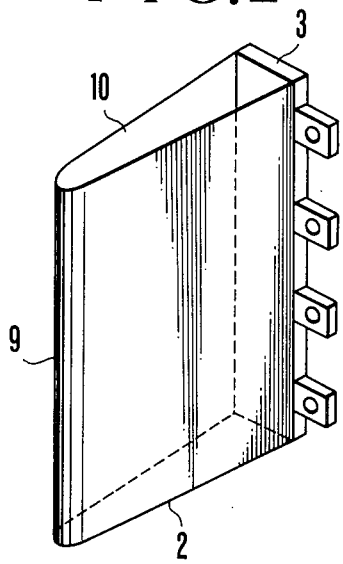
FIG. 2 is a slanted view of one of the finger-anodes installed in the anode compartment.

In the figures, 1 is a separating wall. On the anode compartment side of the separating wall 1, a plurality of finger-anodes 2, prepared as described below, are connected with electricity suppliers 3 which are supported by electricity supply bars 4 which is connected to the separating wall 1. The finger-anode 2 is made of an anodic plate of an expanded metal of which the base material is titanium and is coated with an anodically active substance such as ruthenium oxide and is worked to be folded at the middle to form a U-shaped horizontal cross-section.

On the cathode compartment side of the separating wall 1, cathode-backscreens 5 are made having some distance from the separating wall 1. Finger-shaped hollow cathodes 6 are connected through the cathode-backscreen 5 with the electricity supply bar 4. The peripheral portion of the cathode-backscreen 5 is jointed to the flange 7 of the electrolysis bar in the cathode compartment. Thus, the inside space of the finger-cathodes 6 and the space between the separating wall 1 and the cathode-backscreen 5 form the cathode compartment.

In order to prevent the possible bending of the finger-anodes 2 to the inside, each finger-anode is provided with a reinforcing anode support which extends the full length of the finger-anode 2.

Figure 3:
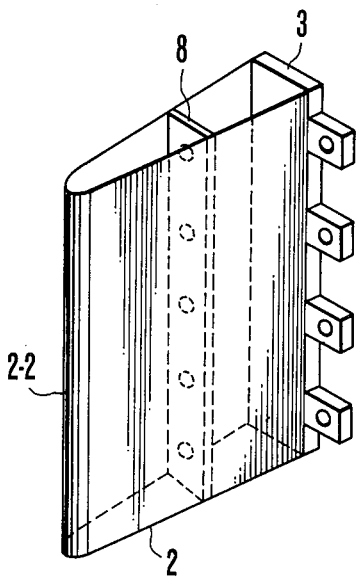
FIGS. 3 and 4(*a*),(*b*) and (*c*) respectively show an example of the finger-anode according to the present invention.
Figure 4A:
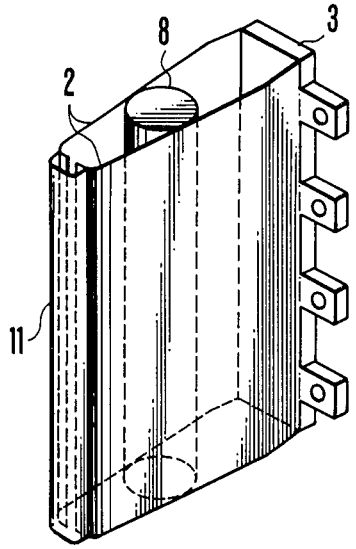
Figure 4B:
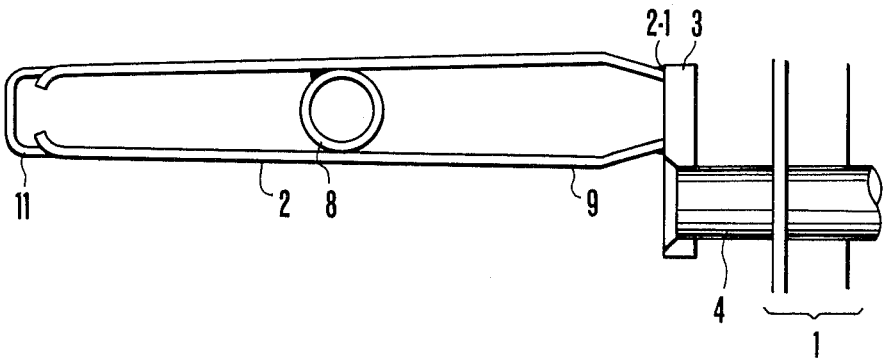
Figure 4C:
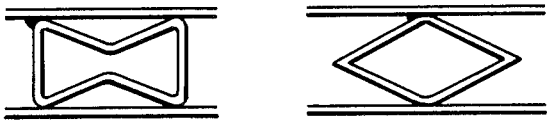
Figure 5:
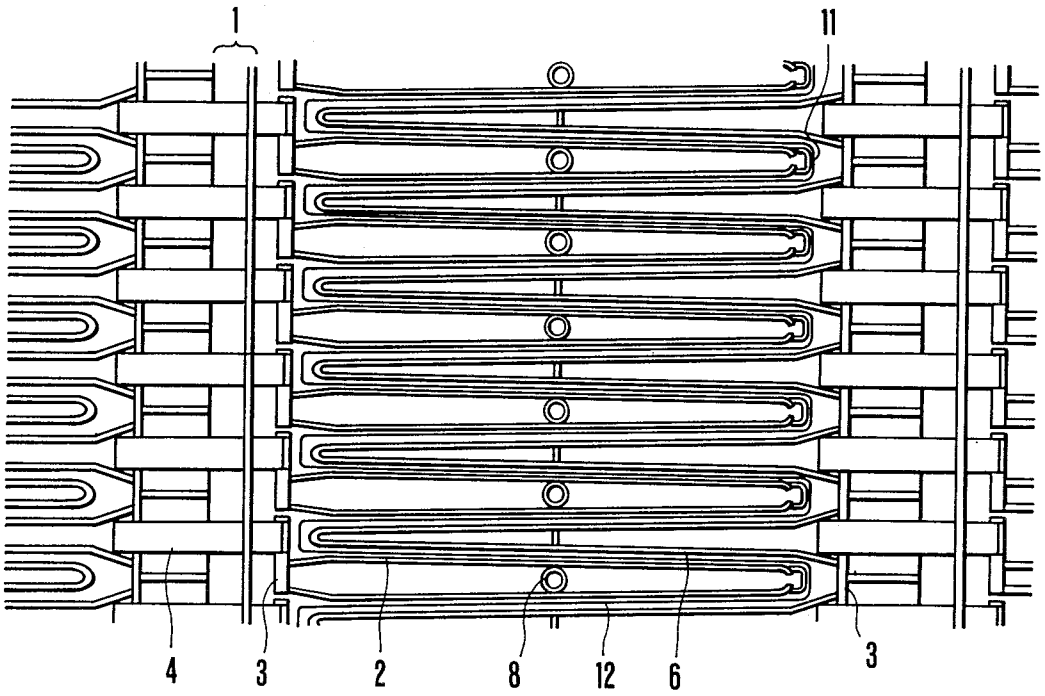
FIG. 5 shows an embodiment of the double electrode diaphragm-type electrolysis tank according to the present invention.
Figure 6A:
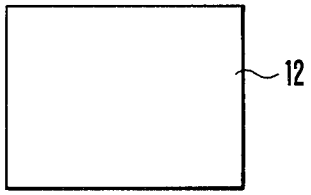
FIGS. 6(*a*) to (*e*) and FIGS. 7(*a*) to (*c*) show the manufacturing steps of the bag-like cation exchange membrane according to the present invention.
Figure 6B:
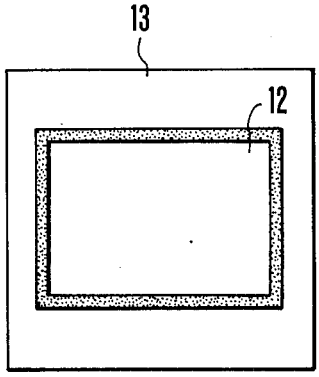
Figure 6C:
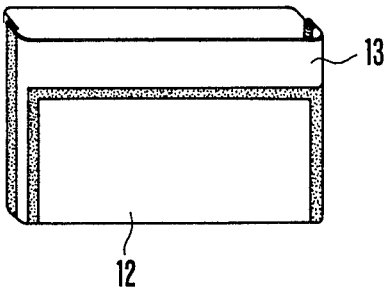
Figure 6D:
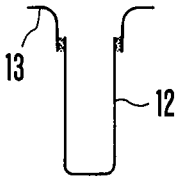
Figure 6E:
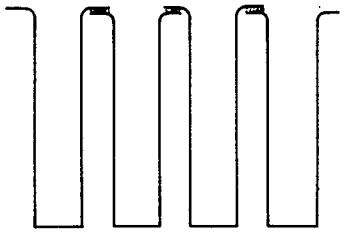

FIGS. 3 and 4(*a*) through (*c*) are slanted views of examples of the U-shaped finger-anodes 2 in the inside of which anode support 8 is installed.

As shown in FIGS. 4(*a*) and (*b*), the anodic plate of the finger-anode 2 is cut into two pieces, and each of them is bent at the position 9, 10 to 50 mm apart from the junction 2-1 with the electricity supplier 3, so as to keep an appropriate distance from the opposing finger-cathode. The spacing between two anodic plates is fixed by installing an anode support 8. Thus, the distance from the anode to the cathode can be maintained with high precision, and the voltage across the electrolysis tank can be reduced.

The anode support 8 extends to almost the full longitudinal length of the anodic plates. The anode support is installed by spot- or TIG-welding to attain the spot or linear contact with the anodic plates.

When the distance between the top and the root of finger-anodes exceedes 400 mm, at least two anode supports are desired, one at the top of the finger-anode and the other at the place within 200 mm from the junction with the electricity supplier. Otherwise, the anode supports may be placed at two or more locations so as to evenly divide the full length of the finger-anode.

The anode supports may be installed in any manner. For example, a finger anode is taken out of the anodic compartment and an anode support 8 with an appropriate width and length is inserted into the upper or lower opening of the finger, followed by a fixing at the ends. Or, the top end 2—2 of the finger-anode is cut in the longitudinal direction to separate the anode into two anodic plates. An anode support 8 is fixed to one of the anodic plates, and then the top portion is again fixed. When this cutting work is performed, the distance between the anode and the cathode can be adjusted to any desired value by changing the spread of the finger-anode and the magnitude of the anode support.

An electrolysis tank of which each finger-anode is cut at the extreme end into two anode plates and each plate is held at a position closer to the opposing finger-cathode can be used conveniently without disassembling the individual finger-anodes, but instead by simply inserting and fixing anode support 8 and jointedly fixing the top ends of the finger-anode plates by means of the bridge plate 11.

The bridge plate 11 may be made of an expanded metal coated by the same anodically active substance as with the anode, and the plate itself may have holes. The bridge plate may also be made of an anti-chlorine resin because only a small current density is applied to this portion.

The anode support can be made of any material as long as it resists materials which are formed in the anodic compartment such as chlorine, but the most preferred is titanium since the base material of the anode is also titanium. The anode support may also be coated with an anodically active substance. Any shape of the anode support, a solid post, a hollow pipe or a plate with holes in it etc., is permited. Among them, however, a hollow pipe is particularly preferred since the hollow space accelerates the circulation of the anodic solution. The inner surface of the hollow pipe should preferably not be coated with any anodically active substance. Further, it is preferable that the pipe be fixed to the finger-anode so as to attain point contact, instead of planar contact. Then, application of a cation exchange membrane to the double electrode diaphragm-type electrolysis tank which contains the installed finger-anode with the anode support follows.

In case a cation exchange membrane 12 is used which covers the finger-cathode 6 beforehand and the finger-anodes are set up in the electrolysis tank, the bridge plates should preferably have smoothly finished surfaces such as those of metal or plastic plates, so as not to scratch the cation exchange membrane while the tank is being set up.

When an alkali chloride is electrolysed with a double electrode diaphragm-type electrolysis tank having the anode structure of this invention and a cation exchange membrane, the distance between the anode and the cathode with the anion exchange membrane in between can be made smaller than when an asbestos diaphragm is used and the inter-electrode distance at the root positions of the fingers can be made uniform, leading to a lower voltage across the tank. The anode supports installed in the finger-anode function to prevent bending of the finger-anode, and also to maintain the predetermined inter-electrode distance. When the anode support is hollow, it functions to accelerate the circulation of the electrolyte solution in the finger-anode, which effectively serves to maintain a uniform concentration of alkali chloride in the anodic compartment, thus leading to an operation with a high current efficiency.

In the process of this invention, the cation exchange membrane is used in the form of a continuous sheet having a number of bag-like extrusions which accomodate the finger-anodes one by one, instead of being used in the form of separate bags each of which encloses a finger-anode. In this invention, the opening portions of adjacent bag-like cation exchange membranes are fused together directly, by pressing which under heat or indirectly, by means of an easily fusible sheet. The sheet thus prepared is united with a sheet which contains connections with a number of peripheral flanges. The sheet is applied to the electrolysis tank by being sealed at the flanges on the tank and each bag-like portion of the membrane accomodates a finger-anode.

In the usual electrolysis using a double electrode type electrolysis tank, the voltage across the tank is so high (200 to 800 V) and the leak current flowing through the common headers is larger than when a single electrode-type electrolysis tank is used. Therefore, in the so called inner mechanical sealing process in which individual finger-cathodes and a cation exchange membrane are sealed with a material such as a metal resistant to an electrolytic solution, problems due to incomplete sealing as a result of the local corrosion of the sealing material in the long run, contamination of impurities into the electrolysis products and a lowering of the current efficiency are likely to occur as well as the lowered durability of the sealing material itself over a long period of time.

If the cation exchange membrane can be sealed at the flanges of the electrolysis tank as in the case of the present invention, fears of contamination, impurities and lowered current efficiency can be completely eliminated.

As ion exchange membranes to be used in this invention, all the membranes are prepared from the polymers which contain such cation exchange groups as carboxylic, sulfonic acid, and phosphonic acid groups. Particularly suited for this invention, from the standpoint of durability and thermal resistance, are fluorine-containing polymers.

In addition, the ion exchange membrane may contain one or more exchanging groups. For example, the exchanging groups on one side may be different from those on the other side of the membrane. Two or more exchanging groups may be present on a single membrane.

The continuously connected bag-like cation exchange membranes which are important composing factors of this invention can be prepared, for example, by such a method as proposed by the present inventors in Japanese Patent Application No. Sho 57-125849. FIGS. 6(*a*) through (*e*) show an example of the process of producing the membrane.

At first, around a cation exchange membrane sheet 12 (see FIG. 6(*a*)), a framing sheet 13 (see FIG. 6(*b*)) made of a tetrafluoroethylene-hexafluoropropylene copolymer (hereinafter designated as FEP) or tetrafluoroethylene-perfluorovinylether copolymer (hereinafter designated as PFA) is joined at a temperature 300°–400° C., under a pressure 0–40 kg/cm$^2$ for a period of time of 10–20 sec. (see. FIG. 6(*b*), the joined portion is hatched). The obtained sheet is folded and the framing sheet 13 of FEP is jointedly attached at the two edges on the outer side, to obtain a bag-like cation exchange membrane unit (see FIG. 6(*c*)). Then the framing sheet 13 of FEP is flared (see FIG. 6(*d*)) at the opening part of the bag at a temperature of 150°–300° C. and under a pressure of 1–20 kg/cm$^2$. Flares of adjacent bag membranes are jointed together through a melting process under the above-mentioned condition, to prepare a continuous bag-like membrane (see FIG. 6(*e*)).

Figure 7A:
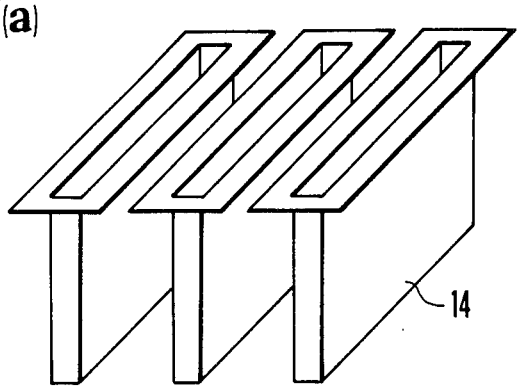
Figure 7B:
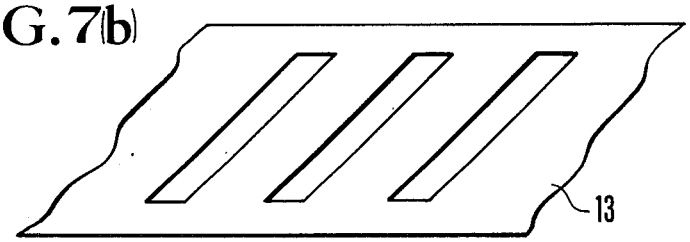
Figure 7C:
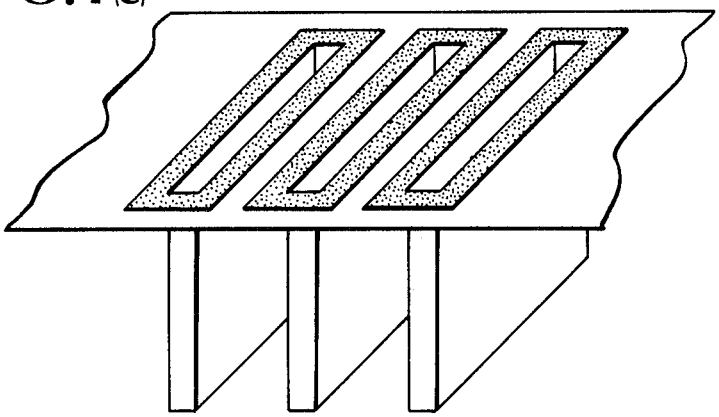

On the other hand, as shown in FIG. 7(*a*) through (*c*), a framing sheet 13 made of FEP or another suitable material may be cut to make a series of rectangular openings each of which fits to the bag-like cation exchange membrane 14 (corresponding to that in FIG. 6(*d*)). Each opening can accomodate a bag-like membrane 14 one by one and the sheet and the membrane can be jointly fused to each other (the jointed part is hatched in FIG. 7), to prepare a continuous bag-like cation exchange membrane.

The bag-like membrane thus prepared endures the operation of electrolysis for a long period of time, since FEP and PFA sheets have excellent properties against close adhesion and mechanical strength at the portions where the flare and bending processes have been applied.

When a cation exchange membrane having a carboxylic group as the exchanging group for which copolymers of polytetrafluoroethylene $CF_2=CFO(CF_2)_3COOCH_3$ are representative, is used and the exchange group is in the form of an ester such as $COOCH_3$, the cation exchange membrane in a sheet is folded and the edges on the two sides among the three open sides are jointly fused together at a temperature of 130°–300° C. for 10–20 seconds under a pressure of 1–30 kg/cm$^2$, to prepare a bag-like membrane. Flares are made on the open ends of the bag-like membrane at a temperature of 200°–300° C. and under a pressure of 1–5 kg/cm$^2$, to make a bag-like exchange membrane having a flare worked flange. Individual adjacent bag-like cation exchange membranes are jointly fused together at their corresponding flares in the condition just mentioned. In this way a continued bag-like cation exchange membrane can be prepared.

The cation exchange membranes thus prepared in the form of continued bags are installed in the electrolysis tank with sufficient care, not to be ruined by scratches caused from contact with the bag-like ion exchange membrane on the finger-cathodes or finger-anodes.

The method of installing the continued bag-like ion exchange membrane is not particularly specified. For example, the continued bag-like ion exchange membrane is placed on the finger-cathodes so that each bag accomodates a cathode, and the cathode compartment is kept under a reduced pressure to assure a close covering of the ion exchange membrane on the finger-cathodes. Then the covered finger-cathodes are installed in the space between the finger-anodes in the anodic compartment. This should be one of the preferred methods to avoid damages of the continued bag-like ion exchange membranes.

The cation exchange membrane thus installed is completely sealed in the state in which it is put between flanges of the cathode and the anode compartments when the electrolysis tank is finally assembled tightly.

Using the cathode-type electrolysis tank in which the continued bag-like cation exchange membrane is installed, and supplying an alkali chloride solution to the anode compartment, a caustic alkali is to be basically produced by electrolysis in the cathode compartment.

Next, conditions of the electrolysis of the present invention will be described in detail, taking as an example the production of sodium hydroxide (or caustic soda) by the electrolysis of an aqueous solution of sodium chloride and using the schematic diagram of FIGS. 8 through 10.

Figure 8:
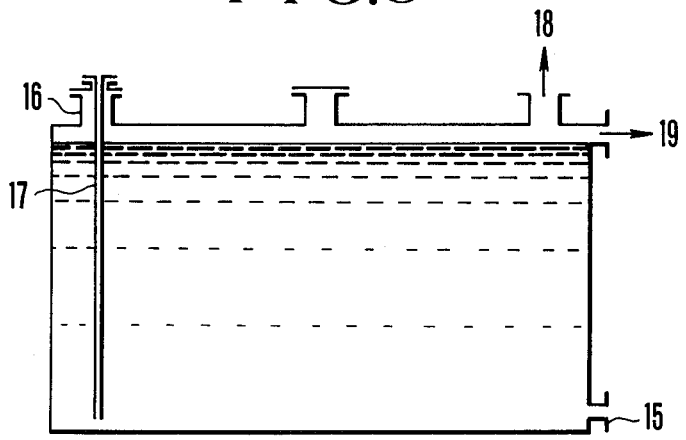
FIG. 8 shows the liquid level on the anode side in the present invention.

The aqueous solution of sodium chloride is supplied to the bottom of the anode compartment as can be seen in FIG. 8. The solution may be supplied through the feed-nozzle 15 provided at the lower flange on the anode side of the electrolysis tank or through the anti-chlorine tube 17 which is inserted from the nozzle 16 onto the upper corner to supply the sodium chloride solution to the bottom of the anode compartment. In this case chlorine gas generated and a dilute saline water 19 are taken away at the upper end of the opposite side.

The supply and taking-away of the sodium chloride solution in the anode compartment permit the concentration of sodium chloride in the compartment to be kept at a constant level.

Figure 9:
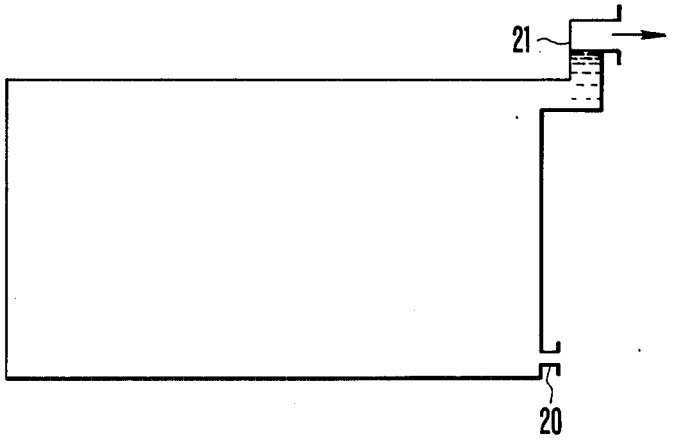
FIGS. 9 and 10 show the liquid level on the cathode side in the present invention.
Figure 10:
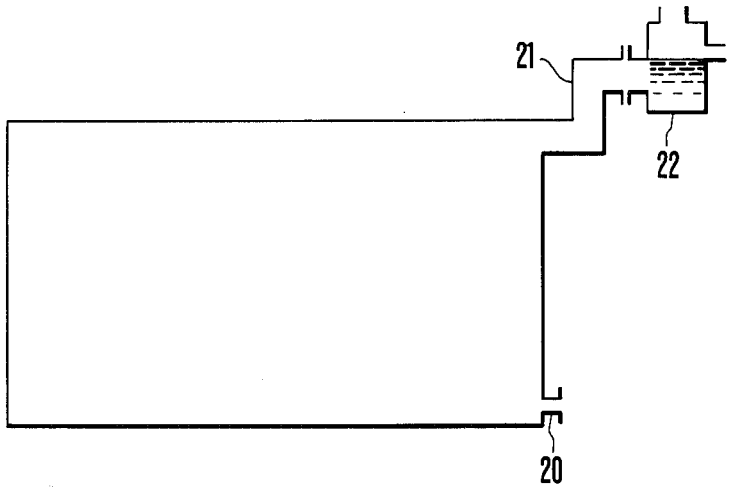

On the other hand, a supply is made of water or a dilute aqueous solution of sodium hydroxide for the lower part of the cathode compartment as shown in FIGS. 9 and 10. The supply can be made conveniently without reconstruction of the electrolysis tank, if the dilute aqueous solution of sodium hydroxide is delivered through the nozzle 20 at the lower side which is used as an exit nozzle for sodium hydroxide in the former asbestos-type electrolysis method. Hydrogen gas generated and sodium hydroxide produced are taken out in a mixed state of gas and liquid through the nozzle 21 at the upper part of the cathode compartment. The reason why sodium hydroxide and hydrogen gas are taken out while in a mixed state is given below. According to the inventors' investigation, the iron content of the product sodium hydroxide was proven to be significantly high when hydrogen gas and sodium hydroxide were taken out separately, that is, hydrogen gas from the upper nozzle and sodium hydroxide from the upper portion of the side of the cathode compartment. So far, the process of taking out hydrogen and sodium hydroxide via separate routes has been considered an effective means to minimize the fluctuation of the pressure in the cathode compartment and to decrease the area in which the cathode compartment comes in contact with the sodium hydroxide solution in order to prevent corrosion when the cathodes and the cathode compartment are composed of a soft steel. The present inventors, however, found that the iron concentration in the product sodium hydroxide becomes smaller when the hydrogen and the sodium hydroxide produced in the cathode compartment are taken out from a nozzle situated at the upper portion of the cathode compartment.

In this invention it is desirable that during electrolysis the level of solution in the cathode compartment is maintained at the level of the upper nozzle in the cathode compartment as shown in FIG. 9 or at a higher level by adding a gas-liquid separator 22 as shown in FIG. 10, and on the other hand to keep the solution level in the anode compartment at a level equal to or lower than the solution level in the cathode compartment. Consequently the cation exchange membrane is pushed toward the anode as a result of a different specific gravity of solutions in the anode and cathode compartments, leading to a lower voltage which is necessary for the electrolysis. In connection with this fact, it is also desirable to reinforce the finger-anodes by installing anode supports, as for example, those shown in FIGS. 3 and 4(*a*)-(*c*), to withstand the pressure from the cathode compartment. Thus, a sodium chloride solution is steadily supplied at a constant speed to the anode compartment in the inside of each finger-anode and also the distance between both electrodes can be maintained at a small value. Therefore, the electrolysis of a sodium chloride solution becomes possible having a lower voltage applied across the electrolysis tank and also having a high current efficiency.

Concerning the conditions of electrolysis not mentioned above, those which are known when a cation exchange membrane is used, may be applied. More particularly, a temperature of 50°-95° C., a current density of 10-30 A/dm$^2$ and a concentration of sodium hydroxide of 20-40% by weight are employed, but preferred values are 85°-95° C., 15-25 A/dm$^2$ and 30-38% by weight, respectively.

In short, the process of this invention can be summarized below. Using a conventional double electrode diaphragm-type electrolysis tank, a continued bag-like ion exchange membrane prepared of a cation exchange membrane is installed, instead of an asbestos diaphragm, between finger-anodes and finger-cathodes and said cation exchange membrane is tightly sealed at the flanges around the electrolysis tank, for assembly of the electrolysis tank. Then alkali chloride is supplied to the bottom of the anode compartment and water or an alkali hydroxide is supplied to the bottom of the cathode compartment. The alkali hydroxide formed and the hydrogen gas which evolved are taken out in the form of a mixture from the nozzle at the upper portion of the cathode compartment. During electrolysis the solution level in the cathode compartment is maintained at the level of the nozzle located at the upper part of the cathode compartment, while the solution level in the anode compartment is kept equal to or lower than that in the cathode compartment. By following this procedure, alkali hydroxides of high purity containing little iron and alkali chloride can be produced having a high concentration and a high current efficiency which remains stable for a long period of time.

The present invention is particularly useful to produce potassium hydroxide from potassium chloride and sodium hydroxide from sodium chloride. The latter is more preferred.

The present invention will be explained in detail with particular reference to the examples.

EXAMPLE

The finger-shaped anodes of a conventional double electrode diaphragm-type electrolysis tank having a height dimension of 1220 mm and length of 335 mm, and a U-shaped cross-section composed of ½ mesh titanium expanding metal which was coated by ruthenium oxide, were cut at the top with a gas burner cutter for the purpose of separating it into two anode plates. Each anode plate was bent toward the outside at a site 25 mm from the base connected to the electricity supplier, so that the anode plates are situated 2.5 mm from the bag-shaped finger-cathodes having a U-shaped cross-section 335 mm long and 16 mm wide at the top, 25 mm wide at the base. At the middle inside area of the two anode plates, a titanium pipe, 1220 mm long, 28 mm inner- and 31 mm outer-diameter, was point-welded by the TIG welding. A 1220 mm long, 1.5 mm thick bridging plate was fixed at the cut ends of the two anode plates by the TIG welding. The bridging plate was prepared of a expand-rolled mesh of which the base material was smoothly processed and ruthenium oxide coated titanium.

To a double electrode type electrolysis tank provided with said reconstructed finger-anodes and 44 finger-cathodes, a continued bag-like cation exchange membrane containing carboxylic groups prepared by the following method was installed.

A cation exchange membrane made of a copolymer of polytetrafluoroethylene and $CF_2=CFO(CF_2)_3COOCH_3$ was processed to form bags by the thermal adhesion method. The peripheral part of the opening was heated under pressure to form flares. The membrane bags prepared were 340 mm deep, 1230 mm long, 25 mm wide at the top and 45 mm wide at the opening of bags.

Neighboring flares of 44 bag membranes were fused together to prepare a continuous membrane having 44 bag-like extrusions of which the tops were arranged with a pitch of 65 mm. At last the flared parts were thermally fused onto a copolymer sheet of the same material to form flanges.

The ion exchange membrane having the continuous 44 bags was placed on the finger-cathodes of a double electrode-type electrolysis tank containing 44 finger-cathodes each of which was 1220 mm high, 330 mm long, 45 mm wide at the base and 16 mm wide at the top.

The ion exchange membrane mentioned above was placed in such a manner as to cover the finger-cathodes one by one, and flanges on the membrane were sealed to the flanges of the cathode compartment. The pressure of the cathode compartment was reduced by suction to −50 mm $H_2O$. While the compartment was kept at the reduced pressure with the ion exchange membrane in tight contact with the finger-cathodes, the whole was placed in the anode compartment where the finger-anodes were already installed of which the dimensions were 1200 mm high, 330 mm long, 35 mm at the maximum width, and in the inside, anode supports were installed. Thus, a double electrode-type electrolysis tank was constructed.

Next, the pressure of the cathode compartment was increased up to +100 mm $H_2O$ and kept at the value for 20 min., but the pressure of the anode compartment did not change at all, demonstrating a complete absence of defects of the ion exchange membrane.

In the electrolysis tank thus assembled, 27% by weight of sodium hydroxide and 305 g/l of sodium chloride solution were placed in the cathode and anode compartments, respectively. The treatment was carried out for 40 hours at a temperature of 70° C. using the cation exchange membrane.

An aqueous solution of sodium chloride, 305 g/l, was supplied through a tube and a nozzle placed at the upper corner of the anode compartment into the bottom of the anodes, and a chlorine gas and a dilute solution of the salt were taken out from the nozzle at the upper corner on the opposite side. On the other hand, 31% by weight of sodium hydroxide was supplied from the nozzle at the bottom side of the cathode compartment. Hydrogen gas and sodium hydroxide were taken out from the nozzle at the upper corner in a mixture of gas and liquid. Gas-liquid separators were placed at the exit nozzles in the upper part of the cathode and anode compartments, so that the solution level in the cathode compartment is maintained at a level 100 mm higher than that in the anode compartment.

Electrolysis was carried out with a current of 72 mA at 90° C. In 10 days at the voltage 3.37 V across the tank, 32.3% by weight of sodium hydroxide was obtained with a current efficiency of 95.7%. Very small values of contamination in the sodium hydroxide were obtained, that is 12 ppm for sodium chloride and 0.65 ppm for iron.

Moreover these values remained stable after a 6 month long period of operation, that is the voltage across the tank at 3.38 V, and a yield of 32.1% by weight of sodium hydroxide with a current efficiency of 95.4%. Impurities in the sodium hydroxide amounted to 10 ppm for sodium chloride and 0.60 ppm for iron.

COMPARISON EXAMPLE

Electrolysis of an aqueous solution of sodium chloride was carried out in the same manner as in the Example, except that no reconstruction of the anode was made.

The result was that the voltage across the tank gradually increased from the beginning of the operation, reaching a stable voltage at 3.63 V, and a low current efficiency of 92.5%, and resulted in producing sodium hydroxide in the cathode compartment, and also the oxygen concentration in the chlorine which evolved in the anode compartment was higher by more than 1% by volume than that in the Example.

What is claimed is:

1. A process for producing caustic alkalis or alkaline hydroxides by electrolysis in a bipolar-type electrolysis cell containing a plurality of finger anodes extending into the electrolysis cell from one of two opposing partitioning walls and a plurality of finger cathodes extending from the partitioning wall not having anodes extending therefrom, said anodes and cathodes being positioned in such a way that the electrodes extending from one given partitioning wall project into the space between adjacent electrodes extending from the remaining partitioning wall while maintaining a narrow gap between alternating cathodes and anodes, and said cell containing a continuous cation exchange membrane which separates the anodes and cathodes and which divides the electrolysis cell into an anode compartment containing an alkali chloride solution and a cathode compartment containing water or a dilute solution of an alkali hydroxide, comprising:

conducting the electrolysis of the alkali chloride;

transferring the catholyte which is formed in the cathode compartment and which contains alkali hydroxide and bubbles of hydrogen into a gas-liquid separating means installed at the top of the cathode compartment; and maintaining the level of the liquid in the gas-liquid separating means higher than the level of the anolyte which causes the cation exchange membrane to be pushed toward the anode surface by the pressure which results from the difference in the two liquid levels.

2. The process according to claim 1 in which the cation exchange membrane is made of a polymer containing a cation exchange group selected from the group consisting of carboxylic, sulfonic acid and phosphoric acid groups.

3. The process according to claim 2 in which the polymer is a fluo

* * * * *